US006298205B1

(12) United States Patent
Chigono et al.

(10) Patent No.: US 6,298,205 B1
(45) Date of Patent: Oct. 2, 2001

(54) CHARGING APPARATUS WHICH STORES ELECTRICALLY CONDUCTIVE PARTICLES IN GRANULE FORM

(75) Inventors: Yasunori Chigono, Susono; Harumi Ishiyama; Jun Hirabayashi, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/387,491

(22) Filed: Sep. 1, 1999

(30) Foreign Application Priority Data

Sep. 1, 1998 (JP) ..... 10-247082

(51) Int. Cl.[7] ..... G03G 15/02
(52) U.S. Cl. ..... 399/174; 361/225; 399/176
(58) Field of Search ..... 399/174, 175, 399/258, 148, 176; 361/225; 430/902

(56) References Cited

U.S. PATENT DOCUMENTS 4,174,903 * 11/1979 Snelling ..... 399/148
4,851,960 7/1989 Nakamura et al. ..... 361/225
5,708,939 * 1/1998 Oikawa et al. ..... 399/252
6,038,418 * 3/2000 Chigono et al. ..... 399/174
6,081,681 * 6/2000 Nagase et al. ..... 399/174

FOREIGN PATENT DOCUMENTS 6-3921 1/1994 (JP) .

* cited by examiner

*Primary Examiner*—Joan Pendegrass
(74) *Attorney, Agent, or Firm*—Fitzpatrick, Cella, Harper & Scinto

(57) ABSTRACT

A charging apparatus for charging a member to be charged, the charging apparatus includes a charging member for electrically charging the member to be charged; and electroconductive particle supplying means for loosening electroconductive particles stored in the form of granules each comprising aggregated electroconductive particles and supplying the loosened electroconductive particles to the charging member.

6 Claims, 11 Drawing Sheets

CHARGING APPARATUS WHICH STORES ELECTRICALLY CONDUCTIVE PARTICLES IN GRANULE FORM

FIELD OF THE INVENTION AND RELATED ART

The present invention relates to a desirable charging apparatus for an image forming apparatus which employs an electrophotographic system or an electrostatic recording system.

In the past, a corona discharging apparatus (corona type charging device) has been widely used as a charging apparatus for charging an image bearing member (member to be charged), for example, an electrophotographic photosensitive member, an electrostatically recordable dielectric member, or the like, in an image forming apparatus, for example, an electrophotographic apparatus, an electrostatic recording apparatus, or the like, to predetermined polarity and potential level.

A corona discharging apparatus is a noncontact type charging apparatus. It comprises an ion discharging electrode constituted of a piece of wire or the like, and an electrode in the form of a shield which surrounds the ion discharging electrode. The shield electrode is provided with an ion discharging opening directed toward the surface of an object to be charged, but, not in contact with the object. In operation, high voltage is applied to the ion discharging electrode and the shield electrode to generate discharge current (corona shower) to which the surface of the object is exposed to be charged to predetermined polarity and potential level.

In recent years, however, a substantial number of contact type charging apparatuses have been proposed, and some of them have been put to practical use as a charging apparatus for a low to medium speed image forming apparatus because of their advantages over a corona type charging apparatus; for example, they are smaller in the amount of ozone production and power consumption.

A contact type charging apparatus comprises an electrically conductive charging member in the form of, for example, a roller (charge roller), a fur brush, a magnetic brush, or a blade, which is placed in contact with a member to be charged, for example, an image bearing member or the like. In operation, charge bias, or electrical voltage with a predetermined potential level, is applied to the contact charging member, which is placed in contact with a member to be charged, for example, an image bearing member or the like, so that the peripheral surface of the object to be charged is charged to predetermined polarity and electrical potential.

The charging mechanism (charging principle) in a contact type charging apparatus comprises a mixture of two charging mechanisms: (1) a mechanism based on electrical discharge, and (2) a mechanism based on direct injection of electrical charge. Thus, the characteristics of a contact type charging apparatus vary depending on which of the two mechanisms is dominant.

(1) Charging Mechanism Based on Electrical Discharge

This is a charging mechanism which charges the peripheral surface of an object to be charged, with the use of the products generated by the electrical discharge which occurs between a contact type charging member and the object to be charged.

In a charging system based on electrical discharge, there is a threshold value. Thus, in order for an object to be charged to a predetermined potential level, voltage, the potential level of which is greater than the predetermined voltage level, must be applied to a contact type charging member. In addition, an electrical discharge based charging system inherently produces by-products, the amount of which, however, may be drastically small compared to those produced by a corona based charging device. Therefore, even if a contact type charging system is employed, it is impossible to completely avoid the problems caused by active ions such as ozone.

(2) Mechanism Based on Direct Electrical Charge Injection

This is a charging system which directly injects electrical charge into an object from a contact charging member so that the peripheral surface of the object is electrically charged. It is called the direct charging system or the injection charging system. More specifically, a contact type charging member, the electrical resistance of which is in a medium range, is placed in contact with the peripheral surface of an object to be charged, to charge the object without triggering the electrical discharge. In other words, this charging mechanism is a charging mechanism which directly injects electrical charge into the peripheral surface of an object to be charged. Principally, it does not rely on electrical discharge. Therefore, even if the potential level of the voltage applied to a contact type charging member is less than a threshold voltage level the object to be charged can be charged to a potential level substantially equal to the potential level of the applied voltage.

Since this direct injection charging system does not involve ion generation, it does not suffer from the ill effects associated with the by-products of electrical discharge. However, since a contact type charging system is a direct system, its performance is greatly affected by the state of contact between a contact type charging member and an object to be charged. Thus, it is very important that a contact type charging member is high in density, that there is provided a sufficient amount of difference in surface velocity between the charging member and the object charged, and that the contact type charging member makes contact with the object to be charged, with a sufficiently high frequency.

Next, the characteristics of the charging mechanism in each of various contact type charging members will be described.

A) Charging by Roller

A contact type charging apparatus which employs a roller type charging method, in other words, it employs an electrically conductive roller (charge roller) as a contact type charging member. It has been widely used because of its safety.

In the case of a charging roller, the charging mechanism based on electrical discharge (1) is the dominant charging mechanism.

A charge roller is formed of rubber or foamed material which is electrically conductive, or the electrical resistance of which is in the medium range. Sometimes, different materials are layered in order to obtain a predetermined characteristic.

A charge roller is provided with elasticity so that a predetermined state of contact can be kept between the charge roller and an object to be charged (hereinafter, photosensitive member). Therefore, a charger roller is given a large frictional resistance on its peripheral surface. Generally, it is enabled to follow the rotation of a photosensitive member, or is driven at a speed slightly different from that of the photosensitive member. Thus, when a charge roller is used to directly inject electrical charge into a photosensitive member, it cannot be avoided that the charge roller is deteriorated in its absolute performance and/or the state of contact between itself and the photosensitive drum by the contaminants adhered to the charge roller and/or the photosensitive member, and as a result, the photosensitive member is nonuniformly charged, in spite of the fact that a charge roller is a contact type charging member. In other words, in the case of a conventional charging roller, the charging mechanism based on electrical discharge is dominant in charging the photosensitive member.

FIG. 11 is a graph which shows the efficiencies of various contact type charging members. The abscissas represents the potential level of the bias applied to a contact type charging member, and the ordinate represents the correspondent potential level of a photosensitive member. The characteristic of a charge roller is depicted by a line A. In other words, the charging of the photosensitive drum begins when the potential level of the voltage applied to the charge roller passes the threshold value of approximately −500 V. Therefore, generally, in order to charge a photosensitive drum to a potential level of −500 V, either a DC voltage of −1,000 V is applied to the charge roller, or an AC voltage with a peak-to-peak voltage of 1,200 V is applied to the charge roller, in addition to a DC voltage of −500 V, so that a difference in potential level greater than the threshold voltage value is always present between the charge roller and the photosensitive drum, and the potential level of the photosensitive drum converges to the predetermined potential level, −500 V.

To describe in more detail, when a charge roller is placed in contact with a photosensitive drum with a 25 $\mu$m thick photoconductor layer, the surface potential level of the photosensitive drum begins to rise as the potential level of the voltage applied to the charge roller is increased beyond approximately 640 V. Beyond 640 V, the surface potential level of the photosensitive drum linearly increases at an inclination of 1. This threshold potential level is defined as a charge initiation voltage Vth.

In other words, in order to increase the surface potential level of a photosensitive drum to a potential level of Vd, a DC voltage with a potential level of Vd+Vth, which Is greater than the target surface potential level for the photosensitive drum, is necessary. This method in which only DC voltage is applied to a contact type charging member to charge an object is called a DC charge system.

However, it is rather difficult to change the value of the potential level of a photosensitive member to a desired value with the use of a DC charge system, because the resistance value of a contact type charging member varies due to changes in ambience, and also because the value of Vth changes as the thickness of the surface layer of the photosensitive member changes as it is shaved.

Thus, various proposals to uniformly and reliably charge a photosensitive drum have been made. Among such proposals, U.S. Pat. No. 4,851,960 discloses an AC charge system, according to which a compound voltage composed of a DC voltage equivalent to a desired potential level and an AC voltage with a peak-to-peak voltage of 2×Vth is applied to a contact type charging member. This proposal intended that AC voltage be used to make the potential level uniform. As a result, the potential level of an object to be charged converges to the voltage value of Vd, the center of the top and bottom peaks of the AC voltage, which is not affected by external disturbance such as changes in ambience.

However, even in the case of such a contact type charging apparatus as the one described above, its charging mechanism principally relies on the electrical discharge which occurs between a contact type charging member and a photosensitive member. Therefore, the potential level of the voltage applied to a contact type charging member needs to have a value greater than the value of the potential level to which a photosensitive drum is to be charged. As a result, ozone is produced, although the amount is microscopic.

Further, when an AC charge system is used for the uniformity of charge, an additional amount of ozone is generated, and the contact type charging member and the photosensitive member are vibrated by the electric field generated by the AC voltage, which results in noises (AC charge noises). Further, the deterioration or the like of the peripheral surface of the photosensitive drum is very severe. These are new problems.

B) Charging by Fur Brush

In this charging method, a member with a brush portion formed of electrically conductive fibrous material is used as a contact type charging member (fur brush type charging device). In operation, the brush portion formed of electrically conductive fibrous material is placed in contact with a photosensitive member as an object to be charged, and charge bias with a predetermined potential level is applied to the brush portion to charge the peripheral surface of the photosensitive drum to predetermined polarity and potential level.

Also in the case of this fur brush type charging system, the dominant charging mechanism is the aforementioned charging mechanism based on electrical discharge (1).

There are two fur brush type charging devices which have been put to practical use: a fixed type, and a roller type. The former comprises a piece of pile composed by weaving fibrous material with an electrical resistance in an intermediary range, into base cloth, and attaching electrodes to the pile, whereas the latter comprises a metallic core and a piece of pile, similar to the one for the fixed fur brash type charging device, wrapped around the metallic core. As for the pile, those with a fiber density of approximately 100 strands/mm$^2$ can be relatively obtainable. However, in order to charge a photosensitive member in a sufficiently uniform manner by the direct injection of electrical charge, such a fiber density is not high enough to maintain a satisfactory state of contact between the charging masher and the photosensitive drum. Thus, it is necessary to provide between the peripheral surfaces of the charging member and photosensitive member such a velocity difference that is impossible to mechanically realize, which is not practical.

The characteristics of a fur brush type charging device when DC voltage is applied are depicted by a line B in FIG. 11. In other words, also in the case of a fur brush type charging device, whether it is of a fixed type or a roller type, a photosensitive drum is charged mostly through electrical charge generated by the application of charge bias with a potential level higher than the target potential level.

C) Charging by Magnetic Brush

In this charging method, a magnetic brush, that is, electrically conductive magnetic particles magnetically confined in the form of a brush on a magnetic roller or the like, is used as a contact type charging member. In operation, a magnetic brush is placed in contact with a photosensitive member, and charge bias with a predetermined potential level is applied to charge the peripheral surface of the photosensitive drum as an object to be charged, to predetermined polarity and potential level.

In the case of a magnetic brush type charging device, the dominant charging mechanism is the direct charging mechanism (2).

When electrically conductive magnetic particles ranging 5–50 $\mu$m in diameter are used to form the magnetic brush, and a sufficient amount of difference in peripheral surface velocity is provided between the magnetic brush and a photosensitive drum, the photosensitive drum can be uniformly charged by the direct charge injection.

As is depicted by a line C in FIG. 11, that is, the graph which shows the characteristics of various types of charging devices, this magnetic brush type charging device can charge a photosensitive drum to a potential level substantially proportional to the potential level of the bias applied to a charging member.

However, this device also has its own problems. For example, it is complicated in structure, and some of the electrically conductive magnetic particles of which the magnetic brush is composed, fall off and adhere to a photosensitive drum.

Japanese Patent Laid-Open Application No. 3,921/1994 or the like discloses a method for charging a photosensitive drum by directly injecting electrical charge into the charge retaining portions, for example, the trap levels or electrically conductive particles in the charge injection layer, of the photosensitive drum. This method does not rely on electrical discharge. Therefore, the potential level of the voltage to be applied to a charging member by this method has only to be as high as the potential level to which the photosensitive drum is charged, and also, it does not generate ozone. Further, it does not require the application of AC voltage. Therefore, there is no charging noise. In other words, this method is a superior charging method to a roller type charging method in that it does not produce ozone, and consumes a smaller amount of electrical power.

D) Toner Recycling System (Cleaner-less System)

In a transfer type image recording apparatus, the developing agent (toner) which remains on a photosensitive drum (image bearing member) after image transfer, or residual developing agent (residual toner), is removed from the peripheral surface of the photosensitive drum by a cleaner (cleaning apparatus) and becomes waste toner. From the standpoint of environmental protection, it is desired that waste toner is not produced. Thus, an image recording apparatus which employs a toner recycling system (or toner recycling process) has been realized. In this type of an image recording apparatus, there is no cleaner, and the residual toner which remains on a photosensitive drum after image transfer is removed from the photosensitive drum by a developing apparatus (developing-cleaning process). In other words, the residual toner is recovered by the developing apparatus.

The developing-cleaning process is a method in which the toner remaining on a photosensitive drum after image transfer is recovered by a tog removal bias (difference Vback between potential level of DC voltage applied to developing apparatus and potential level of peripheral surface of photosensitive drum) during the development of a latent image which follows image transfer. According to this method, the residual toner is recovered by a developing apparatus and is used in the following image formation cycles. In other words, no toner is wasted; waste toner is not produced, reducing the amount of maintenance labor. Further, being cleaner-less makes a cleaner-less recording apparatus advantageous in terms of space; a cleaner-less recording apparatus can be drastically smaller compared to a recording apparatus with a cleaner.

In a toner recycling system, the residual toner is passed through a charging station and then a developing apparatus, instead of being removed from the peripheral surface of a photosensitive drum by a dedicated cleaner as described previously, so that it can be recycled to be used for the development processes in the following image formation cycles. Thus, a toner recycling system has its own problem, that is, how to properly charge a photosensitive member, with toner which is electrically insulative, being present in the contact portion between the photosensitive drum and a contact type charging member, since when a contact type charging member is employed as a means for charging a photosensitive member in a cleaner-less recording apparatus, the residual toner is definitely present between the photosensitive drum and the contact type charging member. When a photosensitive member is charged by a roller type charging member or a fur brush, the residual toner on the photosensitive drum is evenly scattered to remove the patterns in which the residual toner was distributed, and the photosensitive drum is charged mostly through the electrical discharge caused by the application of relatively large bias. When a magnetic brush is used to charge a photosensitive member, a brush portion composed of electrically conductive magnetic particles, that is, powder, flexibly contacts the photosensitive drum to charge it.

The inventors of the present invention had proposed a charging apparatus which employed electrically conductive particles as charging performance enhancing particles, which was disclosed in U.S. application Ser. Nos. 09/035,109, 09/035,108 and 09/035,022. According to this proposal, electrical charge is directly injected into an object to be charged, with the presence of microscopic particles, named charging performance enhancement particles, with a diameter of no more than $10^{12}$ Ω.cm between a charging member and the object to be charged. One of the roles of the charging performance enhancement particles is to reduce the friction between the charging member and object to be charged. In the case of a charging member such as the aforementioned charge roller or the like, it is very difficult to maintain a sufficient amount of difference in peripheral velocity between the charging member and the object to be charged, because the friction generated between the charging member and the object to be charged becomes too large. Therefore, there is not a sufficient number of opportunities for the charging member to make good electrical contact with the object to be charged. However, the aforementioned placement of the charging performance enhancing particles between the charging member and photosensitive member reduces the friction between the charge roller and photosensitive member, making it possible to establish and maintain the difference in peripheral velocity between the two components. Secondarily, the charging performance enhancing particles even out the irregularities in the peripheral surface of the charge roller, improving the state of contact between the charge roller and photosensitive member.

The amount of the charging performance enhancing particles coated on the charge roller is gradually reduced and eventually becomes zero since they adhere also to an object to be charged as a charging operation continues. Therefore, the charging performance enhancing particles should be continuously supplied to the charging member by some means. There are a few simple methods for supplying the charging performance enhancing particles to the charging member. However, when a simple method is used, the charging performance enhancing particles are likely to aggregate or scatter because of their extremely small sizes.

SUMMARY OF THE INVENTION

The primary object of the present invention is to provide a charging apparatus superior in dealing with electrically conductive particles.

Another object of the present invention is to provide charging performance enhancing agent in the form of a granule.

According to an aspect of the present invention, there is provided a charging apparatus for charging the object to be charged, including a charging means and a means for supplying electrically conductive particles to said charging member; wherein said supplying means stores the electrically conductive particles in the form of a granule, and causes the granules of the electrically conductive particle to disintegrate as it delivers the granules to said charging member These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Figure 1:
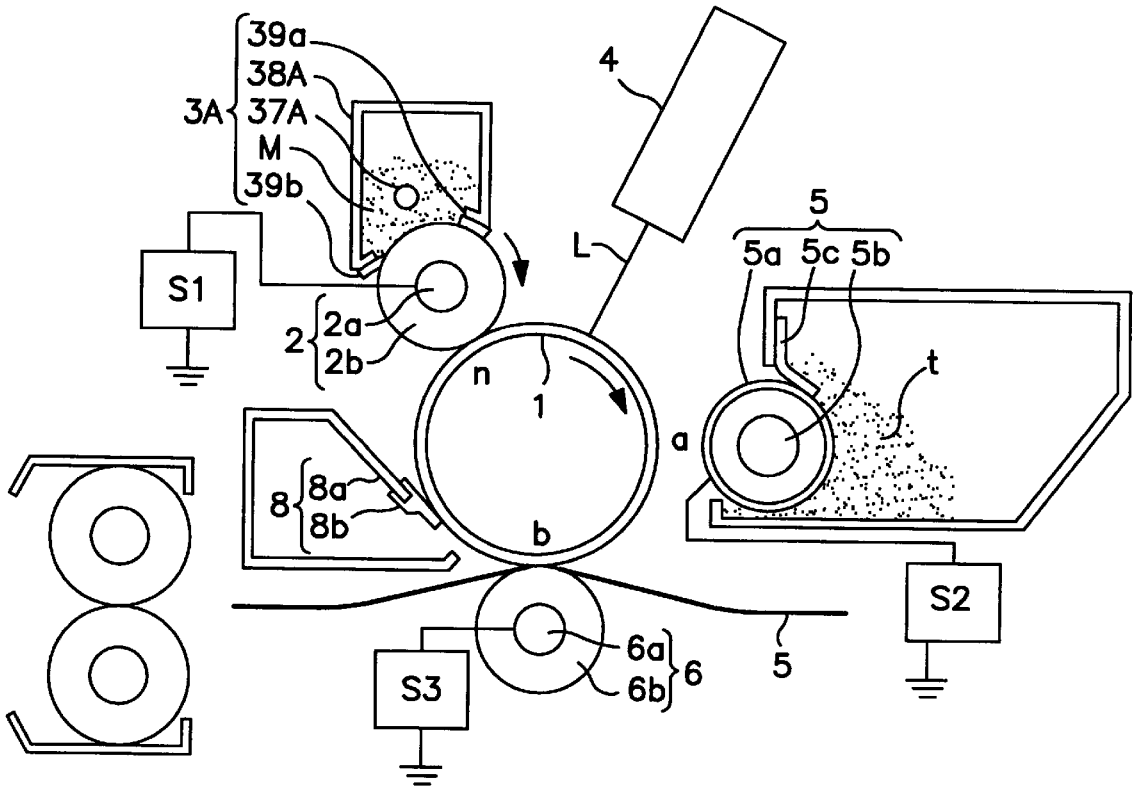
FIG. 1 is a schematic sectional drawing of the image recording apparatus in the first embodiment of the present invention.

FIG. 1 is a schematic sectional view of an image forming apparatus equipped with a charging apparatus in accordance with the present invention.

Figure 2:
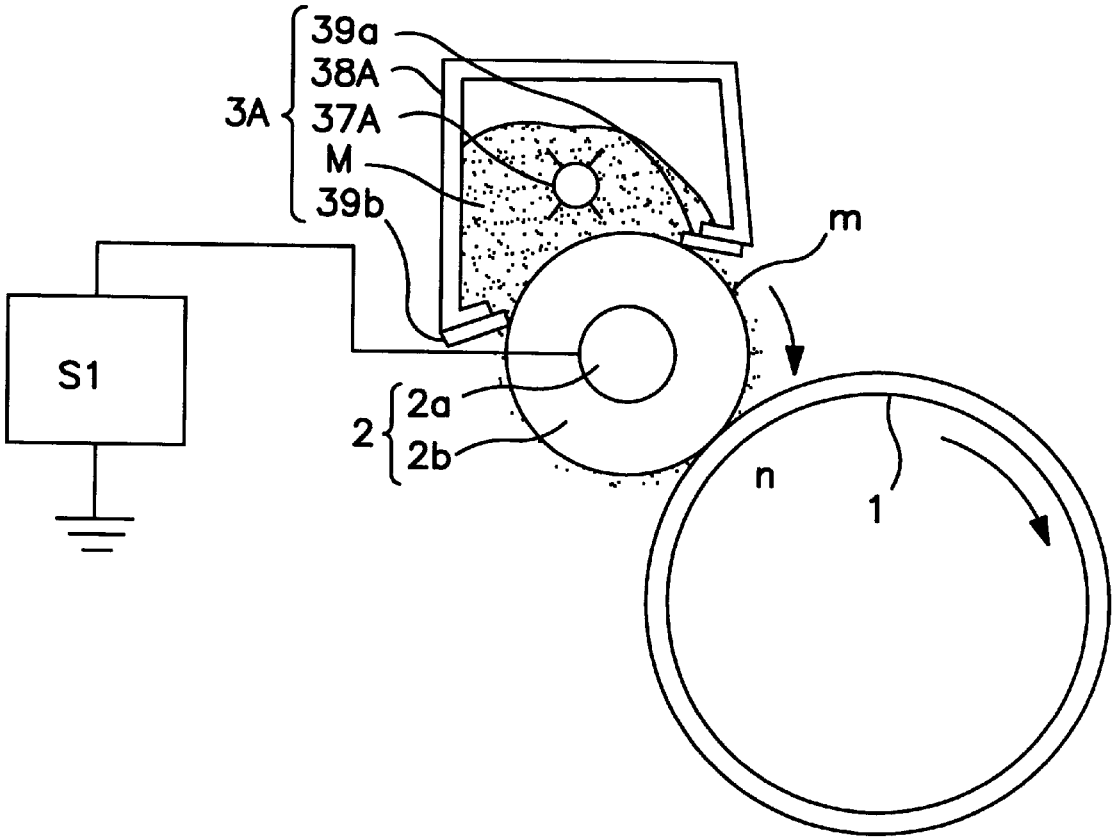
FIG. 2 is a detailed sectional view of the charging apparatus in the first embodiment.

The image recording apparatus in this embodiment is a laser printer which employs a dry electrophotographic process and a contact type charging system. The details of the charging device are given in FIG. 2.

(1) General Structure of Printer

A referential character 1 designates an image bearing member. In this embodiment, the image bearing member is in the form of a rotational drum with a diameter of 30 mm. It is an organic photosensitive member, and is negatively chargeable (hereinafter, photosensitive drum). This photosensitive drum is rotationally driven in the clockwise direction indicated by an arrow mark in the drawing, at a predetermined constant peripheral velocity (process speed PS, or printing speed) of 50 mm/sec.

A charge roller 2 is an electrically conductive elastic roller as a charging member, which is placed in contact with the photosensitive drum 1, with a predetermined pressure.

A referential character n designates a nip between the photosensitive drum 1 and charge roller 2.

A referential character 3A designates a means for supplying the charge roller 2 with particles for enhancing the performance of the charging apparatus. More specifically, charging performance enhancing booster particles m are coated on the peripheral surface of the charge roller 2 by this charging performance enhancing particle supplying means 3A, so that the nip n between the photosensitive drum 1 and the charge roller 2 is supplied with the charging performance enhancing particles m.

The charge roller 2 is rotationally driven in contact with the peripheral surface of the photosensitive drum 1, so that the moving direction of its peripheral surface in the charge nip n becomes opposite to that of the photosensitive drum 1, and also so that there exists a certain amount of difference in peripheral velocity between the photosensitive drum 1 and the charge roller 2.

To the charge roller 2, a predetermined charge bias is applied from a charge bias application power source S1. In this embodiment, a DC voltage of −700 V is applied.

With this arrangement, the peripheral surface of the photosensitive drum 1 is directly and uniformly a charged to a potential level which is substantially equal to the potential level of the bias applied to the charge roller 2. In other words, the peripheral surface of the photosensitive drum 1 is charged by a mechanism which directly injects electrical charge.

The charge roller 2 and charging performance enhancing particle supplying means 3A will be described later in detail, in separate paragraphs.

A referential character 4 designates a laser beam scanner (exposing apparatus) which comprises a laser diode, a polygon mirror, and the like. This laser beam scanner 4 outputs a beam of light L (laser beam), the intensity of which is modulated with sequential digital image signals which reflect the data of an original image. This laser beam L scans, or exposes, the uniformly charged peripheral surface of the aforementioned photosensitive drum 1 which is being rotated.

As the scanning laser beam L exposes the peripheral surface of the photosensitive drum 1, an electrostatic latent image is formed in accordance with the image formation data for the target image, or the original image, on the peripheral surface of the photosensitive drum 1.

A referential character 5 designates a developing device. The electrostatic latent image on the peripheral surface of the rotational photosensitive drum 1 is developed into a toner image, that is, an image composed of toner, by this developing device 5 in a development station a.

The developing device 5 in this embodiment is a reversal tape developing device, and uses single component magnetic toner (negative toner) as developer t. Designated by a referential character 5*a* is a nonmagnetic rotational development sleeve as a member for bearing the developer, that contains a magnetic roller 5*b*. The toner t, that is, the developer, in the developing device 5 is coated on the rotational development sleeve 5*a*, and as the sleeve 5*a* is rotated, the toner t on the sleeve 5*a* is regulated in its thickness, while being triboelectrically charged, by a regulator blade 5*c*.

As the rotational development sleeve 5*a* is further rotated, the toner t on the sleeve 5*a* is carried to a development station a (development region), which is an area in which the peripheral surfaces of the photosensitive drum 1 and sleeve 5*a* become closest to each other. To the development sleeve 5*a*, development bias, that is, electrical voltage, is applied from a development bias application power source S2.

The development bias in this embodiment is a compound voltage composed of a DC voltage of −500 V, and an AC voltage which has a peak-to-peak voltage of 1,600 V, a frequency of 1.8 kHz, and a rectangular wave-form.

With this arrangement in place, the electrostatic latent image on the photosensitive drum 1 is reversely developed by toner t.

The single component magnetic toner t, the developer, is composed of binding resin, magnetic particles, and agent for controlling electrical charge, through the processes of mixing, kneading, pulverizing, and classifying. Further, a developer contains external additives such as fluidizer. The weight average particle diameter (D4) of the toner is 7 $\mu$m.

A referential character 6 designates a transfer roller as a contact type means for transferring an image its electrical resistance is in a medium range. It is placed in contact with the photosensitive drum 1 with the application of a predetermined amount of pressure to form a transfer nip b, or a transfer station. To this transfer nip b, a sheet of transfer medium P as a recording medium is delivered with a predetermined timing from an unillustrated sheet feeding station. As the transfer medium P is passed through the transfer nip b, transfer bias, or electrical voltage with a predetermined potential level, is applied to the transfer roller 6 from a transfer bias application power station S3. As a result, the toner image on the photosensitive drum 1 is continuously transferred, starting from the leading end, onto the surface of the transfer medium P.

The transfer roller 6 employed in this embodiment comprises a metallic core 6*a*, and a layer 6*b* of foamed material coated on the peripheral surface of the metallic core 6*a*. The electrical resistance of the layer 6*b* is in a medium range. The overall electrical resistance of the transfer roller 6 is $5\times10^8\Omega$. In order to transfer an image, a voltage of +2.0 kV is applied to the metallic core 6*a* of the transfer roller 6. As the transfer medium P arrives at the transfer nip b, it is pinched by the photosensitive drum 1 and the transfer roller 6, that is, it is introduced into the transfer nip b, in which the toner image borne on the peripheral surface of the photosensitive drum 1 is continuously transferred, starting from its leading end, onto the surface of the transfer medium P, on the photosensitive drum 1 side, by the electrostatic force and mechanical pressure.

A referential character 7 designates a thermal fixing apparatus. After being delivered to the transfer nip b, and receiving a toner image from the photosensitive drum 1, the transfer medium P is separated from the photosensitive drum 1 and is introduced into this fixing apparatus 7, in which the toner image is fixed to the transfer medium P. Then, the transfer medium P is discharged as a copy from the image forming apparatus.

A referential character 8 designates a cleaner (cleaning apparatus) for a photosensitive drum. After the transfer of a toner image onto the transfer medium P, the rotational photosensitive drum 1 is cleaned by the cleaning apparatus 8. More specifically, the toner which remains on the peripheral surface of the rotational photosensitive drum 1 after the transfer is scraped away by the cleaning member 8*a*, that is, a cleaning blade (elastic blade), placed in contact with the peripheral surface of the photosensitive drum 1 to repeatedly prepare the photosensitive drum 1 for the following image formation. The toner (residual toner) scraped away from the peripheral surface of the photosensitive drum 1 by the cleaning blade 8*a* is accumulated as waste toner in a waste toner bin 8*b* (cleaning means housing).

(2) Charge Roller 2

The charge roller 2 as a contact type charging member in this embodiment comprises a metallic core 2*a*, and a layer 2*b* of flexible or elastic material, for example, rubber or similar foamed material, coated on the peripheral surface of the metallic core 2*a*. The electrical resistance of the elastic layer is in a medium range.

More specifically, the intermediarily resistant layer 2*b* is formed of resin (for example, urethane), which contains electrically conductive particles (for example, carbon black particles), and is treated with a sulfurizing agent, a foaming agent, and the like. It is in the form of a cylindrical roller fitted around the metallic core 2*a*. If necessary, the peripheral surface of the intermediarily resistant layer 2*b* is polished so that the overall diameter of the electrically conductive elastic charge roller 2 becomes 12 mm. Its length is 200 mm.

The measured electrical resistance of the charge roller 2 in this embodiment was 100 kΩ. As for the method used to measure the electrical resistance of the charge roller 2, an overall pressure of 1 kg was applied to the metallic core 2*a* of the charge roller 2*a* so that the peripheral surface of the charge roller 2 was pressed against the peripheral surface of an aluminum cylinder with an external diameter of 30 mm, and a voltage of 100 V was applied between the metallic core 2*a* and the aluminum drum to measure the electrical resistance of the charge roller 2.

It is very important that the charge roller 2, a contact type charging member, also functions as an electrode. In other words, not only must the charge roller 2 be provided with a sufficient amount of elasticity so that it creates and maintains a satisfactory state of contact between itself and an object to be charged, but also it must be low in electrical resistance so that a moving object can be charged to a satisfactory potential level. On the other hand, the charge roller 2 must be capable of preventing a voltage leak which might occur if an object to be charged has defects such as a pin hole. Thus, when an object to be charged is an electrophotographic photosensitive member, the electrical resistance of the charge roller 2 is desired to be in a range of $10^4$–$10^7\Omega$ so that the object can be satisfactorily charged while preventing a voltage leak.

The peripheral surface of the charge roller 2 is desired to be provided with microscopic irregularities so that it can hold charging performance enhancing particles m; the elastic layer of the charge roller 2 is desired to be formed of foamed material.

As for the hardness of the charge roller 2, if the charge roller 2 is extremely low in hardness, it is unstable in terms of shape, failing to maintain the satisfactory state of contact between itself and an object to be charged, whereas if it is extremely high in hardness, not only does it fail to create a satisfactory charging nip n between itself and the object to be charged, but also it is inferior in the state of contact between itself and the object to be charged in terms of a microscopic level. Therefore, the hardness of the charge roller 2 is desired to be in a range of 20° to 50° in ASCAR C hardness scale.

The material for the charge roller 2 does not need to be limited to foamed elastic material. For example, material composed by dispersing an electrically conductive substance such as carbon black, metallic oxide, and the like into elastic material, for example, EPDM, urethane, NBR, silicone rubber, IR, or the like to adjust the electrical resistance of the latter, as well as the foamed form of the thus formed material, may be used as the material for the charge roller 2. Further, instead of dispersing an electrically conductive substance into the base material, ion conductive material may be used to adjust the electrical resistance of the material for the charge roller 2.

The charge roller 2 is pressed upon the photosensitive drum 1 as an object to be charged, with the application of a predetermined pressure, so that the charge nip n with a width of several millimeters (in this embodiment) is formed between the peripheral surfaces of the charge roller 2 and the photosensitive drum 1 due to the elasticity of the surface layer of the charge roller 2.

Also in this embodiment, the charge roller 2 is rotationally drive at a constant peripheral velocity equivalent to approximately 80 rpm in the clockwise direction indicated by an arrow mark in the drawing, so that the moving directions of the peripheral surfaces of the charge roller 2 and photosensitive drum 1 become opposite to each other in the charge nip n. In other words, the charge roller 2 is rotationally driven so that a difference in peripheral velocity is created and maintained between the charge roller 2 as a contact type charging member and the photosensitive drum 1 as an object to be charged.

As for the charge bias, a DC voltage of −700 V is applied to the metallic core 2*a* of the charge roller 2.

(3) Means 3A for Supplying Charging Performance Enhancing Particles

The charging performance enhancing particle supplying means 3A is a device for coating charging performance enhancing particles on the charge roller 2. It comprises a member 37A for stirring the enhancing particles, a container 38A (housing), seals 39*a* and 39*b*, and charging performance enhancing agent M in the form of a granule. The seals are placed in contact with the charge roller 2 by a predetermined pressure.

As for the operation of the coating device 3A, as the stirring member is rotationally driven, the charging performance enhancing granules are moved in the housing. As they are moved, the surface of each granule is shaved. As a result, the granule disintegrates into charging performance enhancing particles m, which are coated on the charge roller 2 by an appropriate amount. It is desired that the particles m are provided in the nip n even when an image forming apparatus is brand new and has never been used, although this is not mandatory.

In this embodiment, the charging performance enhancing agent M is in the form of granules, each comprising a number of charging performance enhancing particles m relatively loosely aggregated (soft granules). The external diameter each granule is approximately 1 mm, it is desired to be within a range of 0.01–10 mm, in particulars 0.1–10 mm. When the external diameter of the granule is smaller than 0.01 mm, the cohesive force which works among the charging performance enhancing granules M is too large for the fluidity of the granules M, whereas when the external diameter of the granule M is larger than 10 mm, the space large enough to satisfactorily stir the granules M cannot be afforded within the apparatus main assembly. As for the characteristic properties of a charging performance enhancing particle m, the specific electrical resistance and average particle diameter of the charging performance enhancing particle m is $10^6$ Ω.cm and 3 μm, respectively. Although the material for the charging performance enhancing particle m in this material is powder of zinc oxide which is electrically conductive, various other electrically conductive particles may be employed; for example, particles of other electrically conductive inorganic substance such as metallic oxide, particles composed of a mixture of inorganic and organic electrically conductive substances, or the aforementioned particles treated on their surfaces.

The electrical resistance of the particles in terms of volumetric resistivity which affects the efficiency with which electrical charge is given or received is desired to be no more than $10^2$ Ω.cm, preferably no more than $10^{10}$ Ω.cm.

The electrical resistance of the charging performance enhancing particle m is determined by measuring the electrical resistance of the charging performance enhancing particle m by a tablet method and normalizing the results of the measurement. More specifically, 0.5 g of the charging performance enhancing particles which are yet to be granulated is placed in a cylinder with a bottom surface area of 2.26 $cm^2$, and are compacted with a pressure of 15 kg through top and bottom electrodes. Then, the electrical resistance of the charging performance enhancing particles in the cylinder was measured while applying a voltage of 100 V between the top and bottom electrodes. Then, the thus obtained resistance value was normalized to obtain the volumetric resistivity of the charging performance enhancing particle.

In order to uniformly charge the peripheral surface of an object, the diameter of a charging performance enhancing particle is desired to be no more than 50 μm. When each charging performance enhancing particle is composed of aggregate of smaller charging performance enhancing particles (primary particles), in other words, each charging performance enhancing particle is a secondary particle, the particle diameter is defined as average particle diameter of the secondary charging performance enhancing particles. As for the method used for measuring the particle diameter, no fewer than 100 charging performance enhancing particles were selected, and their maximum horizontal cord lengths were measured with the use of an optical or electron microscope. Then, the volumetric particle diameter distribution was calculated based on the results of the measurement. Then, the 50% average particle diameter was used as the average particle diameter of the charging performance enhancing particle in this embodiment.

It does not matter whether each of the charging performance enhancing particles in each granule of the charging performance enhancing agent is in the primary state, that is, comprises a single particle, or in the secondary state, that is, comprises two or more particles. In other words, as long as the charging performance enhancing agent properly functions as it is supposed to do, the state in which the charging performance enhancing particles aggregate is not important.

When the charging performance enhancing agent is used for charging a photosensitive member, it is desired to be composed of nonmagnetic, colorless or white particles so that it does not interfere with the process for exposing the photosensitive member to form a latent image.

Further, in consideration of the fact that some of the charging performance enhancing particles are transferred onto the recording medium P from a photosensitive member, the charging performance enhancing particles used in color recording are desired to be colorless or white. Also, in order to prevent exposing light from being scattered by the charging performance enhancing particles while the peripheral surface of a photosensitive drum is exposed for image formation, the diameter of a charging performance enhancing particle is desired to be less than the size of a picture element. From the standpoint of particle stability, the smallest value for the diameter of a charging performance enhancing particle is 10 nm. When the charging performance enhancing agent is granulated as it is in this embodiment, the diameter of a charging performance enhancing particle is preferred to be in a range of 50 nm–5 μm.

The charging performance enhancing agent may be in the state of a naturally occurring granule, or may be turned into granules with a predetermined hardness, with the use of bonding agent. Further, when the charging performance enhancing agent is granular, it may be described as a mixture of charging performance enhancing agent granules different in shape.

The ratio (abrasion ration) by which charging performance enhancing agent granules are disintegrated by friction is desired to be no less than 20%, and no more than 80%. If it is less than 20%, there will not be a sufficient amount of loose charging performance enhancing particles to supply a charging device with a sufficient amount of charging performance enhancing particles, whereas if it is greater than 80%, there will be too large a supply of loose charging performance enhancing particles to properly control the amount of the charging performance enhancing agent to be supplied to a charging device.

The method for measuring the ratio of the charging performance enhancing granules disintegrated by friction was as follows. Ten grams of charging performance enhancing granule sample and 50 steel balls with a diameter of 5 mm were placed in a glass test tube (34 mm in diameter, 100 ml in capacity), and were shaken for 20 minutes with the use of a universal shaker. Then, the mixture was put through a standard screen (Z8801-1987 JIS), the size of each opening of which has ⅕ the average particle diameter of the granule of the charging performance enhancing agent. Then, the weight of the particles which remained on the screen was measured to obtain the ratio of the charging performance enhancing granule disintegration by friction.

The charging performance enhancing agent granules disintegrated one by one into primary charging performance enhancing agent particles due to friction among the granules, due to the stirring by the stirring member 37A, and the friction between the charge roller and granules. The resulting loose charging performance enhancing agent particles passed in a single layer between the charge roller 2 and seal, and moved toward the charging station.

(4) Amount by Which Charging Performance Enhancing Agent is Coated on Charge Roller If the amount of charging performance enhancing agent between the photosensitive drum 1 as an image bearing member and the charge roller 2 as a contact type charging member is extremely small, the lubricational effects of the charging performance enhancing agent are insufficient, in other words, there is too much friction between the charge roller 2 and photosensitive member 1, and therefore, it is difficult to rotate the charge roller 2 while maintaining a predetermined difference in peripheral velocity between the charge roller 2 and photosensitive drum 1. Thus, an extremely large torque is necessary. Moreover, if the charge roller 2 is forcefully rotated, the peripheral surface of the charge roller 2 and photosensitive drum 1 are shaved.

In addition, the smaller amount of the charging performance enhancing agent, or a smaller number of charging performance enhancing particles, means a smaller number of opportunities for electrical contacts between the two components. Therefore, the photosensitive drum 1 cannot be sufficiently charged. On the other hand, if the amount of the charging performance enhancing agent between the charge roller 2 and photosensitive drum 1 is extremely large, the charging performance enhancing particles fall off from the charge roller 2 by a number large enough to have adverse effects upon image formation.

According to an experiment, the amount of the charging performance enhancing particles between the charge roller 2 and the photosensitive drum 1 is desired to be no less than $10^3/mm^2$. If the amount is less than $10^3/mm^2$, the number of the electrical connections established between the charge roller 2 and photosensitive drum 1 by the presence of the charging performance enhancing particles is not large enough to sufficiently enhance the performance of the charging means.

More specifically, the amount of the charging performance enhancing particles between the charge roller 2 and photosensitive drum 1 is desired to be in a range of $10^3$–$5\times10^5/mm^2$. If it is greater than $5\times10^5/mm^2$, the number of the charging performance enhancing particles which fall onto the photosensitive drum 1 is extremely large, which underexposes the photosensitive drum 1 regardless of the optical transmissivity of the charging performance enhancing particles themselves. When it is less than $5\times10/mm^2$, the amount of the charging performance enhancing particles which fall off from the charge roller 2 is small enough not to adversely affect the charging means performance. Since the number of the charging performance enhancing particles which fell onto the photosensitive drum 1 when the number of the charging performance enhancing particles between the charge roller 2 and the photosensitive drum 1 was in the aforementioned range was $10^2$–$10^5/mm^2$, an amount less than $10^5/mm^2$ is desired as the amount which does not adversely affect image formation.

Next, a method for measuring the amounts of the charging performance enhancing agent between the charge roller 2 and photosensitive drum 1, and those on the photosensitive drum 1 will be described. The amount of the charging performance enhancing agent between the charge roller 2 and photosensitive drum 1 is desired to be directly measured at the contact surface between the two components. However, as a given area of the peripheral surface of the photosensitive drum 1 comes in contact with the charge roller 2, the majority of the charging performance enhancing particles which are present on this area are stripped away by the peripheral surface of the charge roller 2 which is moving in the direction opposite to the moving direction of the charging performance enhancing particles on the photosensitive drum 1. Therefore, in this embodiment, the amount of the charging performance enhancing particles which were present on a given area of the peripheral surface of the charge roller 2 immediately before this area of the charge roller 2 came in contact with the photosensitive drum 1 was regarded as the amount of the charging performance enhancing particles between the charge roller 2 and the photosensitive drum 1 in an actual measurement, first, the rotation of the photosensitive drum 1 and charge roller 2, and the application of charge bias to the charge roller 2 were stopped, and the peripheral surfaces of the photosensitive drum 1 and charge roller 2 were photographed with the use of a video-microscope (OVM1000N: Olympus) and a digital still recorder (SR-3100: Deltis). More specifically, the charge roller 2 was pressed upon a piece of slide glass in the same manner as the charge roller 2 is pressed upon the photosensitive drum 1, and the contact surface between the charge roller 2 and photosensitive drum 1 was photographed through the slide glass with the video-microscope fitted with an object lens with 1,000 times magnification. The obtained digital image was subjected to a binary process which used a certain threshold value, so that the image of the contact surface was divided into areas which contained a charging performance enhancing particle, and areas which contained no charging performance enhancing particle. Then, the number of the areas with a charging performance enhancing particle was counted using an appropriate image processing software. The amount of the charging performance enhancing particles on the photosensitive drum 1 was also measured using a method similar to the above described method. In other words, the peripheral surface of the photosensitive drum 1 was photographed with the use of the same video-microscope, and the obtained photograph was subjected to the same process as the one described above.

The amount of the charging performance enhancing particles between the charge roller 2 and photosensitive drum 1 was adjusted by adjusting how the charging performance enhancing agent was supplied to the charge roller 2 by a charging performance enhancing agent supplying device 22. More specifically, granule shape, charging performance enhancing particle density in a granule, amount of granulated charging performance enhancing agent, and the like were adjusted.

(4) Charging by Direct Injection

As the charging performance enhancing articles n are coated on the charge roller 2 by the charging performance enhancing particle supplying means 3A, the particles m are conveyed to the charging nip by the rotation of the charge roller 2. Thus, the photosensitive drum 1 is directly charged with the presence of the charging performance enhancing particles m in the nip n between the photosensitive drum 1 and charge roller 2. With the presence of the charging performance enhancing particles a in the nip n, that is, the contact surface between the photosensitive drum 1 and charge roller 2, even a charge roller which is difficult to keep rotating in contact with the photosensitive drum 1 while maintaining a predetermined difference in peripheral velocity between the peripheral surfaces of the charge roller 2 and photosensitive drum 1, because of the friction between the peripheral surfaces of the charge roller 2 and photosensitive drum 1, can be easily kept rotating in contact with the peripheral surface of the photosensitive drum 1 while maintaining the predetermined difference in peripheral velocity between the charge roller 2 and photosensitive drum 1. In addition, a much larger number of electrical connections are established between the peripheral surfaces of the charge roller 2 and photosensitive drum 1 because of the presence of the particles m between the two surfaces.

Further, difference in peripheral velocity can be established between the charge roller 2 and photosensitive drum 1. Therefore, it is possible to drastically increase the number of the charging performance enhancing particles m which contact the photosensitive drum 1 in the nip n between the charge roller 2 and photosensitive drum 1, and the number of opportunities with which each charging performance enhancing particle contacts the photosensitive drum 1 in the nip n between the charge roller 2 and photosensitive drum 1, so that the number of electrical contacts between the charge roller 2 and photosensitive drum 1 drastically increases. In addition, the charging performance enhancing particles m which are present between the peripheral surfaces of the charge roller 2 and photosensitive drum 1 rub the peripheral surface of the photosensitive drum 1, leaving virtually no gap between the two surfaces.

Figure 11:
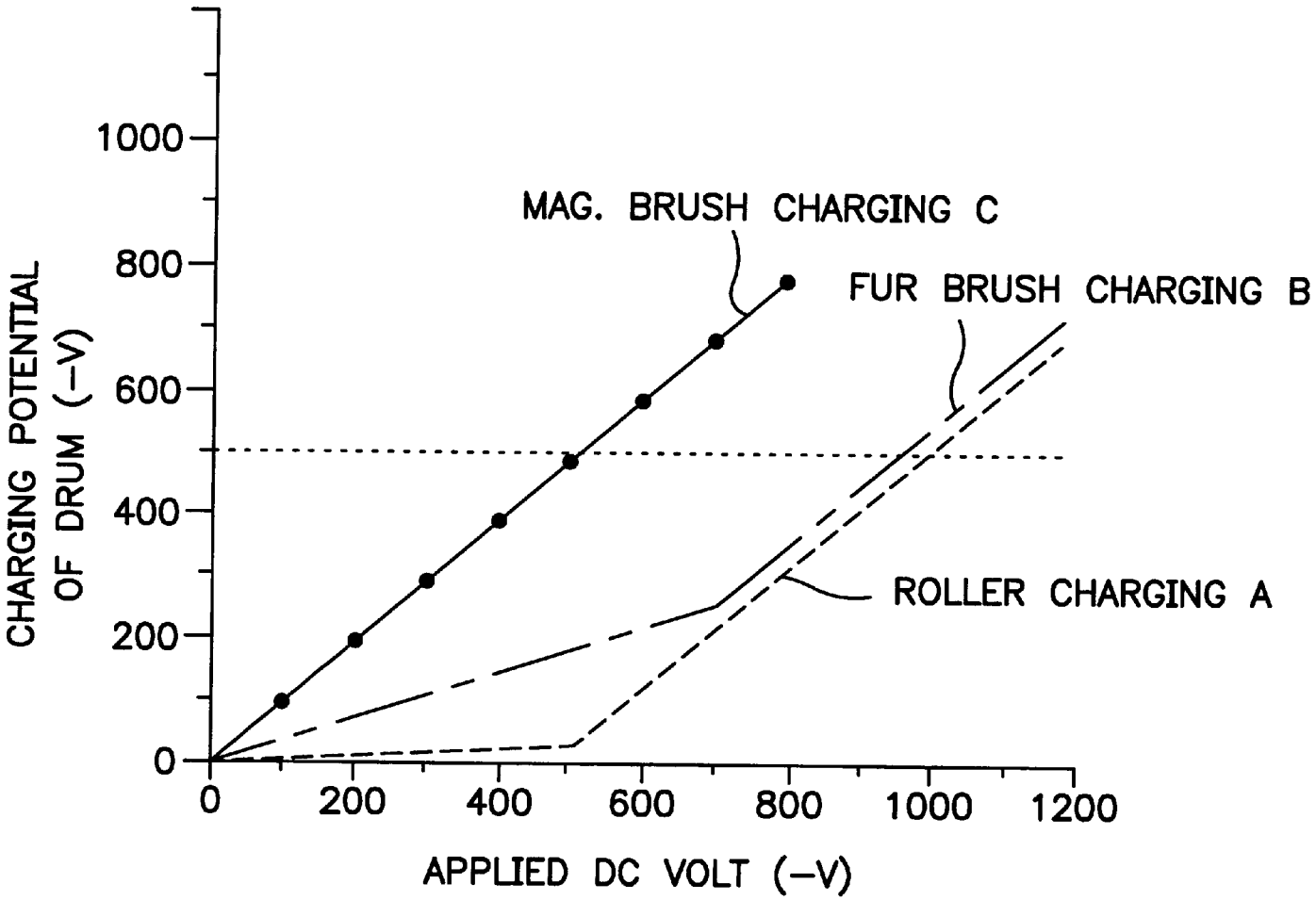
FIG. 11 is a graph which shows the difference in efficiency among various charging members.

Therefore, electrical charge can be directly injected into the photosensitive drum 1. In other words, when a proper amount of the charging performance enhancing particles are present between peripheral surfaces of the charge roller 2 and photosensitive drum 1, it is the direct charge injection that is dominant in the process in which the photosensitive drum 1 is charged though the contact between the photosensitive drum 1 and the charge roller 2. This embodiment made it possible for the charge roller to perform as efficiently as a line C in FIG. 11 depicts.

The image recording apparatus (printer) in this embodiment is provided with a cleaner for removing the toner particles which remain on the peripheral surface of the photosensitive drum 1 after the image transfer from the photosensitive drum 1. However, in reality, it is very difficult to completely remove the residual toner from the peripheral surface of the photosensitive drum 1, in particular, when an elastic blade such as the elastic blade 8*a* employed in this embodiment is used to clean the peripheral surface of the photosensitive drum 1. More specifically, the blade 8*a* is placed in contact with the photosensitive drum 1 in such a manner that the blade edge is prevented from being pulled under the blade itself as the photosensitive drum 1 rotates. This setup allows particles with an extremely small diameter to be carried past the blade 8*a*. In other words, even if an image forming apparatus is equipped with the cleaner 8, toner (electrically insulative substance), negative factor in a charging process, is carried to the charging nip n, though only by an extremely minute amount, past the cleaner 8, and enters between the peripheral surfaces of the charge roller 2 and photosensitive drum 1, occasionally contaminating the charge roller 2.

Even in such a situation as described above, the presence of the charging performance enhancing particles m in the nip n between the photosensitive drum 1 and charge roller 2 prevents the contamination of the charge roller 2, and also compensates for the adverse effects of the toner in terms of the electrical connection between the photosensitive drum 1 and charge roller 2 caused by the toner. In other words, the presence of the charging performance enhancing particles m in the nip n assures that good electrical connection is maintained between the peripheral surfaces of the charge roller 2 and photosensitive drum 1, in spite of the presence of toner in the charging nip, making it possible to directly inject electrical charge into the photosensitive drum 1 to uniformly charge the peripheral surface of the photosensitive drum 1, with the application of relatively low voltage to the charge roller 2, without generating ozone. Further, the presence of the charging performance enhancing particles m in the nip n prolongs the service lives of the charge roller 2 and photosensitive drum 1.

The image forming apparatus in this embodiment is provided with the device for supplying the charging performance enhancing particles m to the charge roller 2. Therefore, even if the charging performance enhancing particles m are gradually lost from the nip n between the photosensitive drum 1 and charge roller 2 as the usage of the apparatus continues, a fresh supply of the charging performance enhancing particles m is carried to the nip n from this device to compensate for the lose, preventing the deterioration of the charging performance of the charging means which occurs because the amount of the charging performance enhancing particles m in the charging nip n reduces as the charging performance enhancing particles m fall out of the charging nip n. Thus, it is assured that the aforementioned ability of the charging means to directly charge an object, or the photosensitive drum 1, lasts for a long time.

Further, the charging performance enhancing agent are stored in the form of a granule which disintegrates into individual charging performance enhancing particles as the charging performance enhancing agent is supplied to the charge roller 2, making the charging means in this embodiment superior to a conventional charging means which stores the charging performance enhancing agent in the form an individual particle which can be coated without any special treatment, in that the charging performance enhancing agent is prevented from being supplied to the charge roller 2 by an excessive amount, that is, the charge roller 2 is supplied with the charging performance enhancing agent only by an amount sufficient to compensate for the amount of the charging performance enhancing agent consumed by the operation of the charge roller 2 (charging performance enhancing agent which falls off from the charge roller 2 and adheres to photosensitive drum 1). Further, the charging performance enhancing agent stored in the form of plain powder is inferior in fluidity, which sometimes causes the charging performance enhancing agent to be nonuniformly coated on the charge roller 2 in terms of the longitudinal direction. However, in this embodiment, the charging performance enhancing agent is stored in the form of a granule which easily flows within the housing for the charging performance enhancing agent. Therefore, the charging performance enhancing agent is coated in such a layer that has little nonuniformity; it is satisfactorily coated.

For the reasons given above, the contact type charging apparatus in this embodiment can charge an object with a higher level of efficiency than could be attained when a conventional charge roller which primarily relied on electrical discharge to charge an objects, was employed. Further, this charging apparatus can charge the photosensitive drum 1 to a potential level substantially the same as the potential level of the voltage applied to the charge roller 2. In other words, in the case of the charging apparatus in this embodiment, the potential level of the bias which must be applied to the charge roller 2 to charge the photosensitive drum 1 to a given potential level has only to be equivalent to the given potential level. As is evident from the above description of this embodiment, according to the present invention, it is possible to provide a contact type charging apparatus which does not rely on electrical discharge to charge an object, and therefore, is reliable and safe, more specifically, a contact type charging apparatus which is simple in structure, requires relatively low electrical voltage, does not generate ozone, is superior in terms of the uniformity of charge, and is stable for a long period of time.

Further, according to the present invention, a charge roller 2, a Simple contact type charging member, can be used to directly charge an object with the application of relatively low voltage, without any problem in spite of the fact that the charge roller 2 is contaminated by toner, and without producing ozone. Therefore, it is possible to produce high quality images for a long period of time with the use of an image forming apparatus which employs a contact type charging system, or an image forming apparatus which employs both a contact type charging system and a transfer system, and also to produce high quality image for a long period time with the use of the aforementioned image forming apparatus even after high resolution images are outputted.

Embodiment 2

Figure 3:
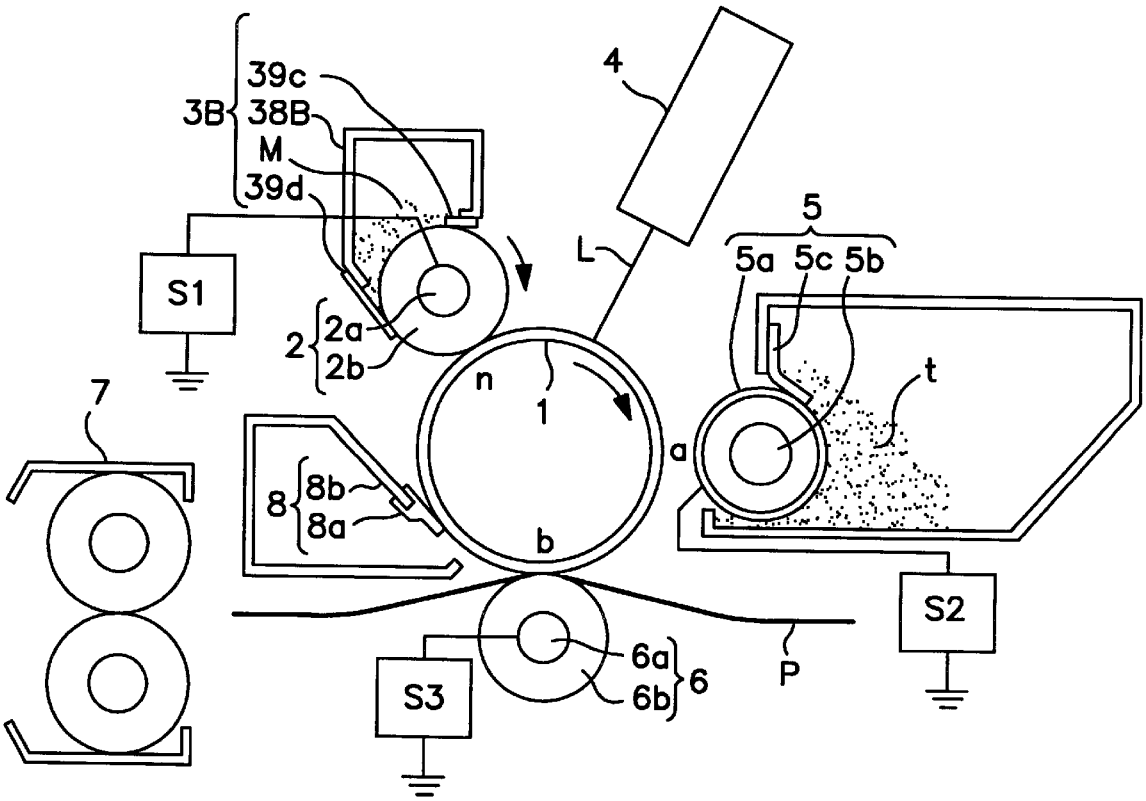
FIG. 3 is a schematic sectional view of the image recording apparatus in the second embodiment of the present invention.

This embodiment is another embodiment of the present invention in the form of an image forming apparatus which comprises a device for supplying charging performance enhancing particles. This charging performance enhancing agent supplying device uses granulated charging performance enhancing agent, and can provide the charge roller 2 with charging performance enhancing particles without the provision of a member for stirring the agent. The general structure of the image forming apparatus is given in FIG. 3, and the details of the charging device are given in FIG. 4. The structure of this image forming apparatus is substantially the same as the structure of the image forming apparatus in the first embodiment, except that this apparatus comprises the device 3A as a device for supplying charging performance enhancing particles.

[Charging Performance Enhancing Particle Supplying Device 3B]

The charging performance enhancing particle supplying device 3B comprises seals 39*c* and 39*d* and a shell 38B. It uses granulated charging performance enhancing agent M. The granulated charging performance enhancing agent M is stored in the shell 38B, and the charging performance enhancing agent granules disintegrate into individual charging performance enhancing particles as they are supplied.

Figure 4:
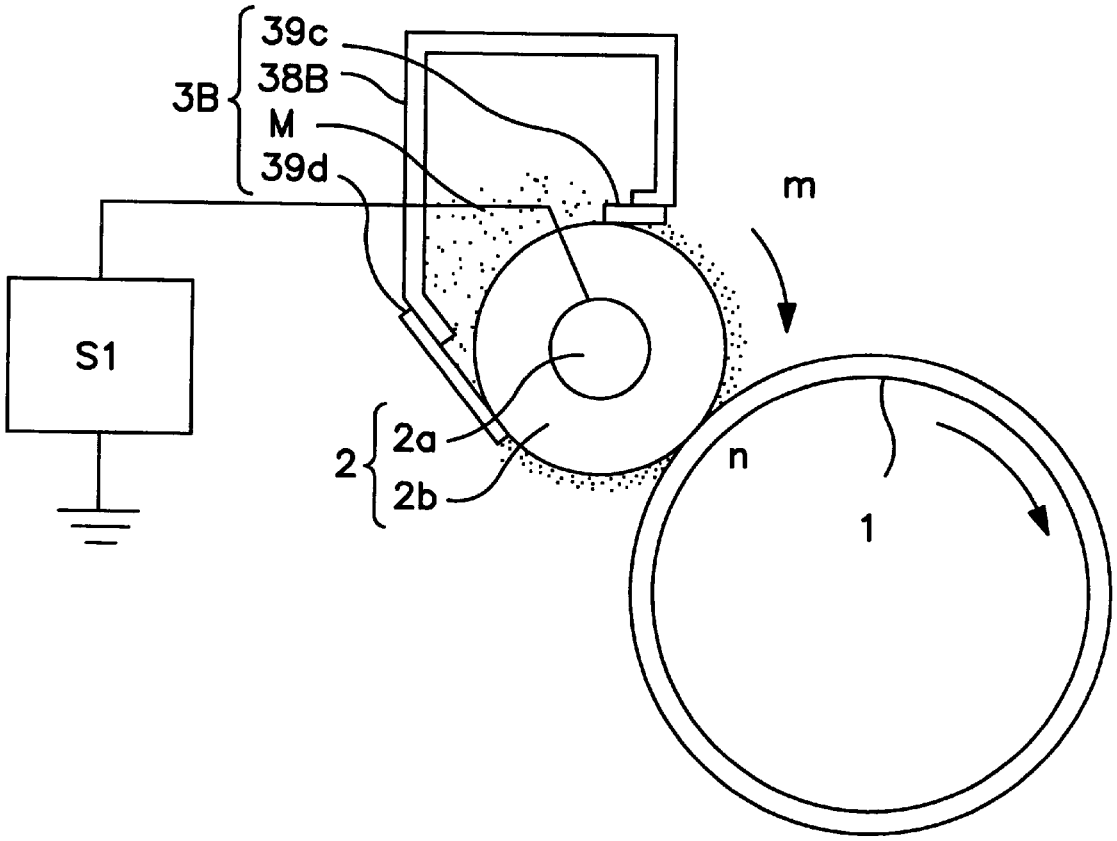
FIG. 4 is a detailed sectional view of the charging apparatus in the second embodiment.

According to the structure depicted in FIG. 4, a member for stirring the charging performance enhancing granules in the shell is unnecessary. More specifically, since the charging performance enhancing agent is in the granulated form, it is evenly distributed within the shell 8B, while disintegrating into individual charging performance enhancing particles, as the charge roller rotates. Therefore, the charging performance enhancing particles can be uniformly supplied to the charge roller.

Embodiment 3

Figure 5:
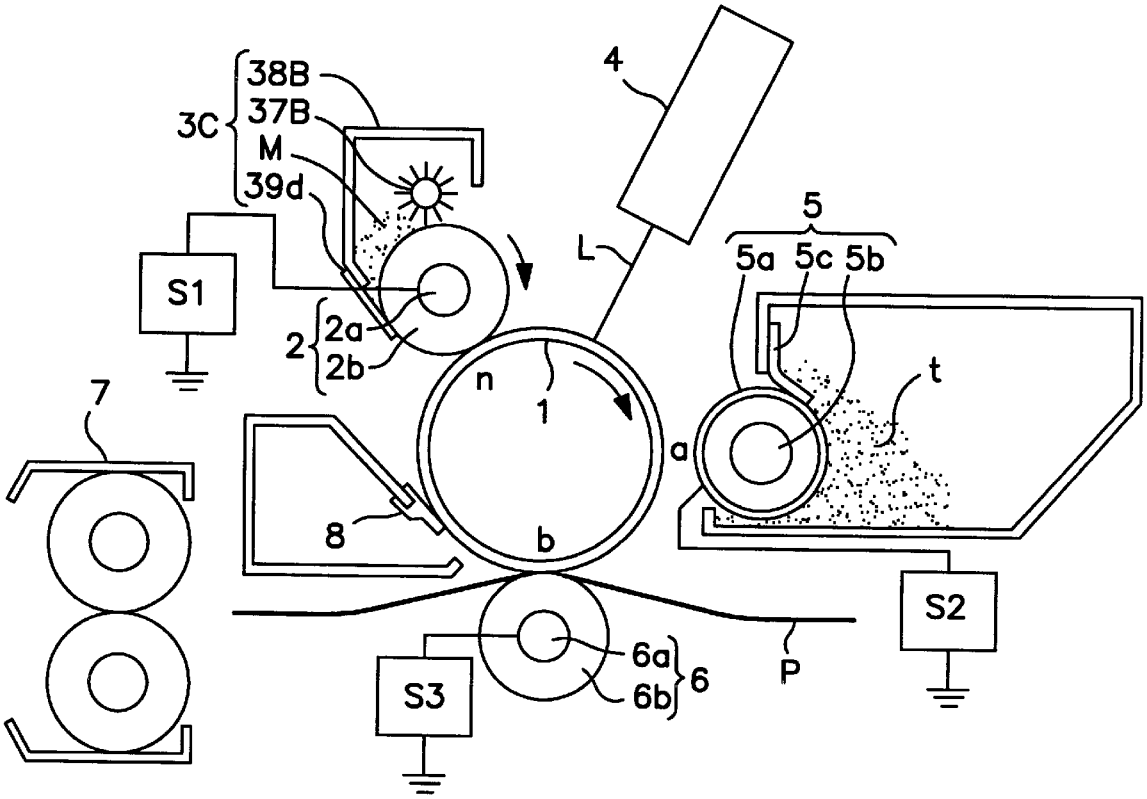
FIG. 5 is a schematic sectional view of the image recording apparatus in the third embodiment of the present invention.
Figure 6:
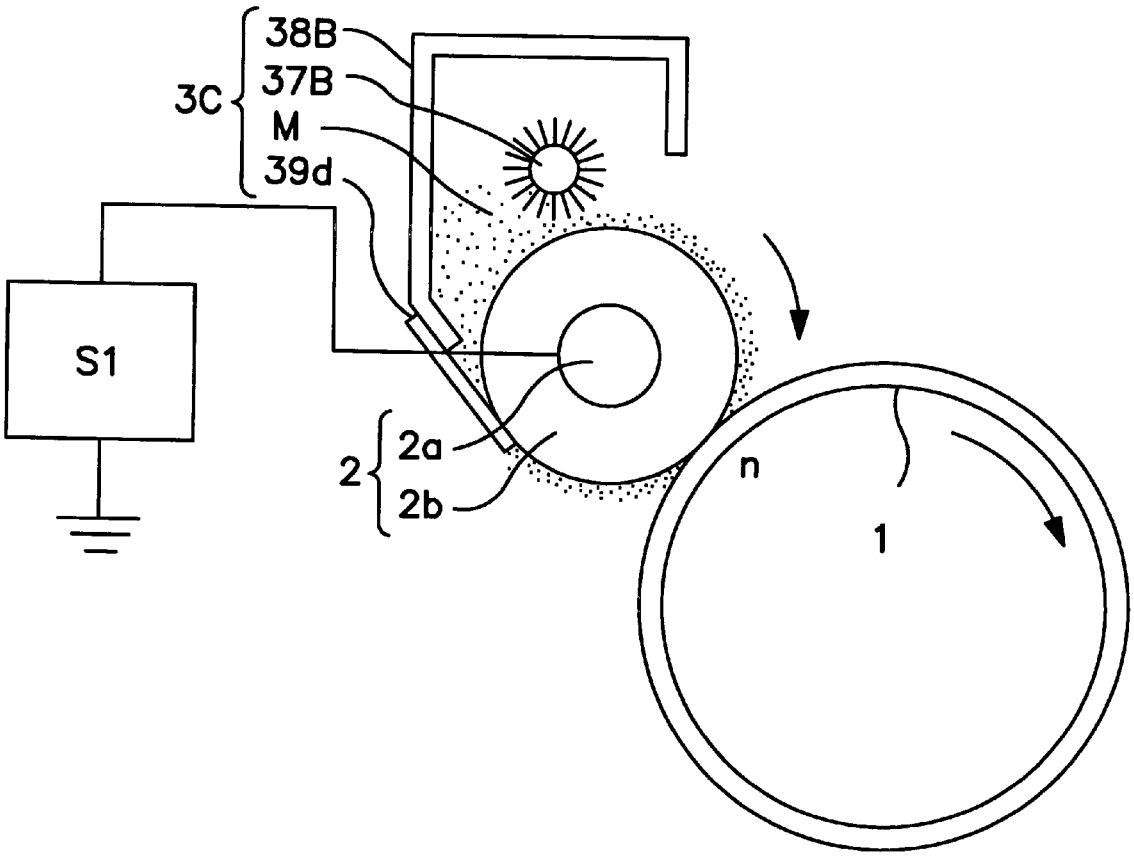
FIG. 6 is a detailed sectional view of the charging apparatus in the third embodiment.

The charging performance enhancing particle supplying device in this embodiment also uses granulated charging performance enhancing agent. In addition. It comprises a rotational fur brush, which is placed in contact with the charge roller, at the point immediately outside the range in which the granulated charging performance enhancing particles are present, and is rotationally driven. The structure of this device is substantially the same as the one in the first embodiment, except that it employs a device 3C as a charging performance enhancing particle supplying device. The general structure of the image forming apparatus in this embodiment, and the details of the charging device in this embodiment, are given in FIGS. 5 and 6 respectively.

[Charging Performance Enhancing Particles Coating Device 3C]

The coating device 3C comprises a seal 39*c*, a shell 38B, and a fur brush 37B. It contains granulated charging performance enhancing agent M.

The fur brush 37B disposed within the shell 38B has a function to remove the excessive amount of the charging performance enhancing particles which adhere to the peripheral surface of the charge roller. More specifically, the charging performance enhancing particles adhere to the peripheral surface of the charge roller as the granules of the charging performance enhancing agent make contact with the peripheral surface of the charge roller. Sometimes, an excessive amount of the charging performance enhancing particles adheres to the peripheral surface of the charge roller due to the presence of irregularities in the peripheral surface of the charge roller. In the case of the coating device structure depicted in FIG. 4, there is a possibility that the excessive amount of the particles on the charge roller, which is in the unstable state of adhesion, might transfer onto the photosensitive drum. Thus, in this embodiment, the coating device is provided with a fur brush which removes the excessive amount of the charging performance enhancing particles from the charge roller and returns it to the coating range so that the excessive amount of the charging performance enhancing particles are prevented from transferring onto the photosensitive drum. In addition, the fur brush functions to remove contamination from the charge roller. More specifically, even though the coating device is provided with a drum cleaner, it is impossible to completely remove the contaminant such as residual developer adhering to the drum, and the contaminant which failed to be removed sometimes adheres to the charge roller. Such contaminants are removed by the fur brush.

Embodiment 4

Figure 7:
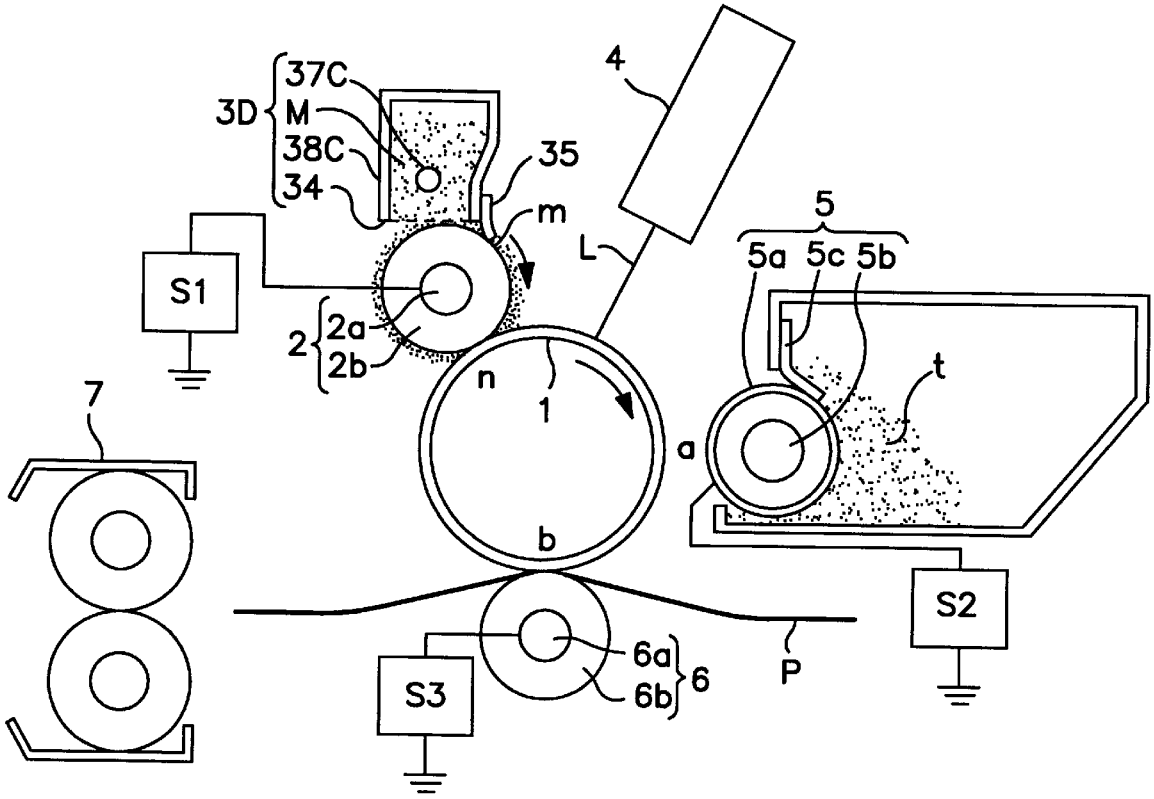
FIG. 7 is a schematic sectional view of the image recording apparatus in the fourth embodiment of the present invention.
Figure 8:
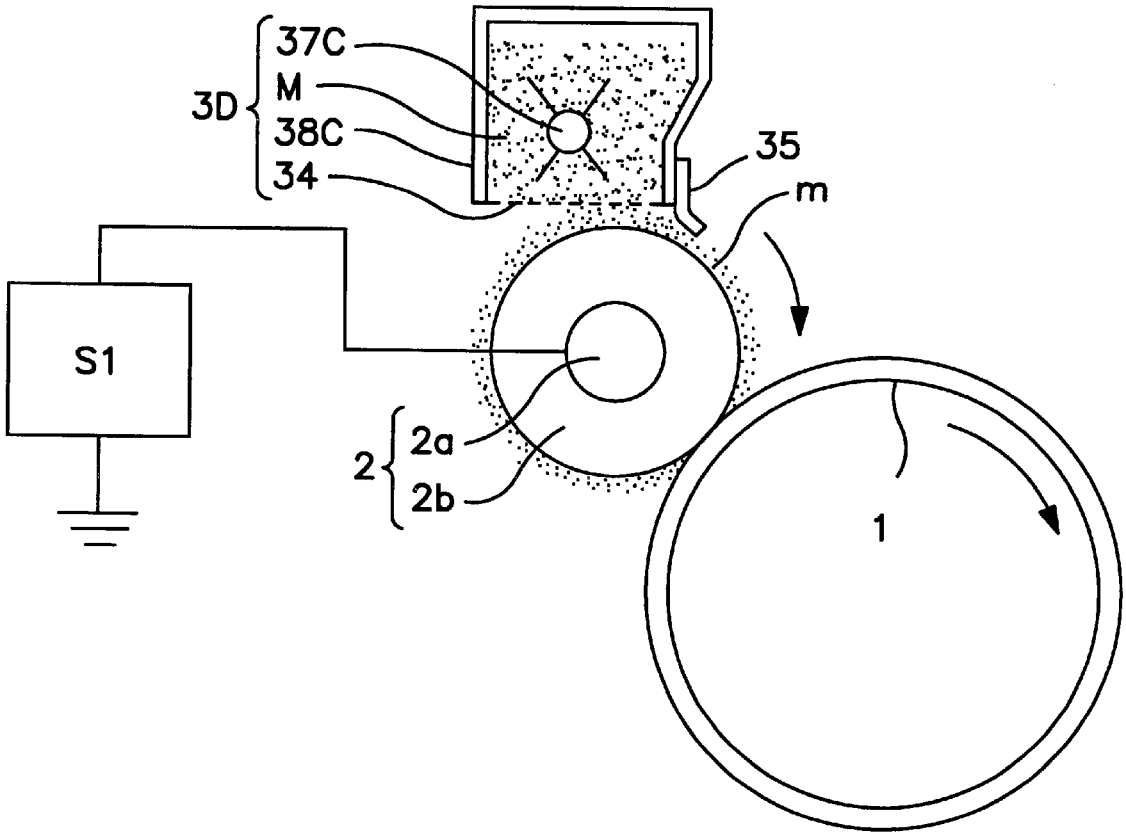
FIG. 8 is a detailed sectional view of the charging apparatus in the fourth embodiment.

The charging performance enhancing agent coating device is structured so that the charging performance enhancing particles are supplied to the charge roller without directly placing the granules of charging performance enhancing agent in contact with the charge roller, realizing a toner recycling system with no drum cleaner. The structure of this coating device is basically the same as that in the first embodiment, except that this coating device employs a supplying device 3C as a charge roller performance enhancing particle coating device. FIG. 7 shows the image forming apparatus, and FIG. 8 shows the details of the charging device.

[Charging Performance Enhancing Particle Supplying Device 3D]

The charging performance enhancing particle supplying device 3D comprises a stirring member 37C, a shall 38C, a mash 34, and a leveling member 35. It uses granulated charging performance enhancing agent M. In operation, the granules of charging performance enhancing agent M are moved in the shell 38C by the stirring member 37C. As they are moved, they disintegrate into individual charging performance enhancing particles, which are supplied to the charge roller through the mesh 34.

In FIG. 7, the toner which remains on the photosensitive drum 1 after the image transfer is carried to the charging nip, in which the photosensitive drum 1 is charged. In other words, the photosensitive drum 1 is charged while the toner from the immediately preceding image formation cycle is still remaining thereon, and is exposed to form an electrostatic latent images in the developing apparatus, an electric field for adhering toner to the "light" portions of the peripheral surface of the photosensitive drum 1, and an electric field for cleaning the "dark" portions of the peripheral surface of the photosensitive drum 1, are created at the same time, so that a development process and a cleaning process are carried out at the same time.

Except for the sections described above, the structure of the image forming apparatus in this embodiment is the same as that of the printer in the first embodiment. Therefore, its description will be eliminated to avoid repeating the same description.

In a cleaner-less image recording apparatus, that is, an image recording apparatus which does not employ a cleaner dedicated to remove the residual toner, that is, the toner which remains on the peripheral surface of the photosensitive drum 1 after image transfer, the residual toner is carried intact to the charging nip n, that is, the contact surface between the photosensitive drum 1 and the charge roller 2, by the movement of the peripheral surface of the photosensitive drum 1. Therefore, the amount of the toner in the charging nip in a cleaner-less image forming apparatus is far greater than that in the printer in the first embodiment which comprises the cleaner 8, and so is the amount of the toner which adheres to the charge roller 2, or mixes into the charging performance enhancing agent on the charge roller 2.

Even in such a situation, the charging performance enhancing particle supplying device in this embodiment can supply the charging nip n, or the contact portion between the photosensitive drum 1 and charge roller 2, with a proper amount of the charging performance enhancing particles m, because this device uses the granulated charging performance enhancing agent, and is structured so that the granules of charging performance enhancing agent are caused to disintegrate into individual charging performance enhancing particles by the friction caused among them by the stirring member, and the individual charging performance enhancing particles are supplied to the charge roller 2 evenly across the peripheral surface of the charge roller 2. As a result, the charge roller 2 is prevented from being contaminated, and the charging nip n is compensated for the adverse effects of the toner in terms of the direct electrical connection between the photosensitive drum 1 and charge roller 2. In other words, the charge roller 2 and photosensitive drum 1 are precisely kept in contact with each other in the charging nip n, while maintaining a proper amount of contact resistance. Therefore, it is possible to provide a reliable charging device which can uniformly charge an object by directly injecting electrical charge into the object, requires relatively low voltage, generates no ozone, and is very durable.

Comparative Example 1

Figure 10:
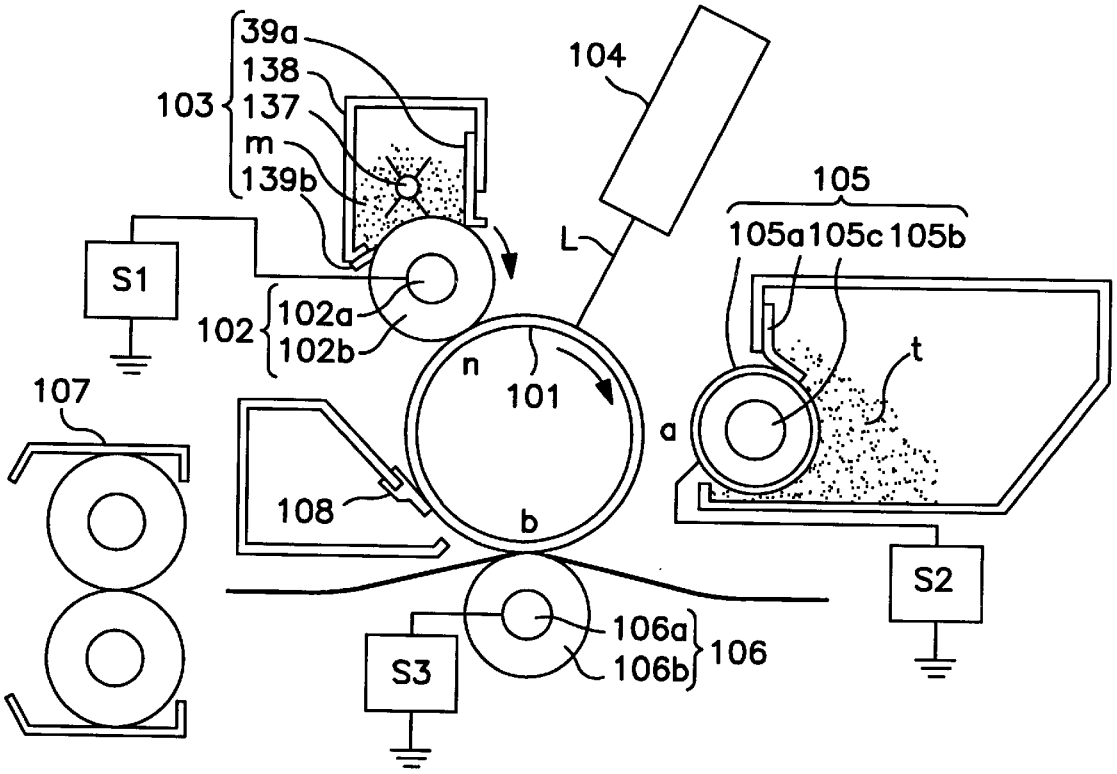
FIG. 10 is a schematic sectional view of a conventional image forming apparatus, a comparative example of an image forming apparatus.

The comparative image forming apparatus illustrated in FIG. 10 is basically the same in structure as the image forming apparatus in the first embodiment. However they are different in the characteristics of the charging performance enhancing particles they use.

[Charging Performance Enhancing Particle]

As for the characteristics of the charging performance enhancing particle m, it is a particle of zinc oxide which is electrically conductive. Its specific electrical resistance is $10^6$ Ω.cm, and its average particle diameter is 3 μm.

In the comparative apparatus, the charging performance enhancing particles, which were microscopic particles, were used as they were. As a result, some of the particles aggregated. Further, because of their poor fluidity, the particles were unevenly supplied to the charge roller 2.

(Evaluation)

The table given below shows the relative evaluations of the preceding embodiments of the present invention, and Comparative Example 1.

TABLE

| | Forms of particles | structures | unevenness of charge in long direction (V) | half-tone image | non-scatter |
|---|---|---|---|---|---|
| EMB. 1 | granules | with stirring member | NMT 30 | E | E |
| EMB. 2 | granules | modified contact portion/ without stirring member | NMT 30 | E | E |
| EMB. 3 | granules | modified contact portion/ with furbrush | NMT 30 | E | E |
| EMB. 4 | granules | witout cleaner/ without contact | NMT 30 | G | G |
| COMP. Ex. 1 | particles | with stirring member | 50–70 | NG | NG |

The evaluations were made based on the number of defects in the image with intermediate tone outputted by each combination of the charging device and charging performance enhancing agent. The image forming apparatus used to form images in these tests was an image forming apparatus comprising a laser scanner with a resolution of 600 dpi. The image with intermediary tone used for these evaluations was outputted by repeating a cycle of recording a single scanning line in the primary direction and skipping the next two lines, creating such a pattern that realized an impression of intermediary tone as a whole. Further the images were formed using a reversal development process. Therefore, a defect which resulted as the exposing process was adversely affected, and a defect which resulted as a leak occurred during the development process, both appeared as a white spot in the final image, and the number of the spots correspondent to these defects were evaluated based on the following standard.

E: no less than 50 white spots with a diameter of no less than 0.33 mm are present in the image of intermediary tone G: 6–49 white spots with a diameter of no less than 0.3 mm are present in the image of intermediary tone NG: no more than 5 white spots with a diameter of no less than 0.3 mm are present in the image of intermediary tone The evaluations were made after printing 100 copies of A4 size (longitudinal direction of A4 size sheet).

In the case of Comparative Example 1, it was detected that a large number of charging performance enhancing particles fell off, and caused image defects during the development process. The reason for this falling of the large number of charging performance enhancing particles seems to be the following.

The forces which hold a charging performance enhancing particle on a charge roller seem to mostly comprise natural adhesive force which works between two substances, and electrostatic force resulting from the triboelectrically chargeable characteristic of the enhancing particle. These forces are by no means great, allowing the enhancing particle to easily transfer onto a photosensitive drum. Further, in reality, as the charging performance enhancing agent is coated on a charge roller, the charging performance enhancing particles are stacked in layers on the peripheral surface of the charge roller, and therefore, the magnitude with which these forces work to confine the particles in the outmost layer is extremely small, or too small to hold the particles, allowing the particles to transfer. Since the thickness of the layer of the charging performance enhancing particles is regulated on the peripheral surface of a charge roller, it cannot be prevented for certain portions of the layer to become thicker than the other portions. In addition, when charging performance enhancing agent is low in fluidity, the thickness of the enhancing agent layer on a charge roller sometimes becomes substantially irregular in terms of the longitudinal direction of the charge roller.

The charging performance enhancing particles which transferred onto a photosensitive drum are responsible for the defects in a final image. More specifically, the portions of the peripheral surface of a photosensitive drum, onto which charging performance enhancing particles transferred, fail to be properly exposed. As a result, these portions manifest as the defects in the final image. The enhancing particles present on the drum during a development process cause other problems which result in defects in the final image. For example, they interfere with the development of a latent image by toner, and also they allow the development bias applied to a development roller to leak.

On the other hand, in the case of Embodiment 1, charging performance enhancing agent is stored in the form of a granule which disintegrates by friction, making it possible for a proper amount of charging performance enhancing particles to be supplied to a charge roller, uniformly across the peripheral surface of the charge roller. Therefore, unlike the charging performance enhancing particles in Comparative Example 1, the charging performance enhancing particles in the first embodiment are prevented from being stacked in layers on the charge roller, and therefore, they do not fall off from the charge roller.

In the case of Embodiment 2, the charging performance enhancing agent coating device was structured so that charging performance enhancing agent in the form of a granule was stirred by the charge roller as it came in contact with the charge roller. Therefore, the stirring nether with which the coating device in the first embodiment was provided was unnecessary. This structure also caused the granules of charging performance enhancing agent to come in contact with the charge roller, so that the charging performance enhancing particles were evenly distributed across the peripheral surface of the charging roller as was developer.

In the case of Embodiment 3, the fur brush was rotationally placed in contact with the charge roller so that the charging performance enhancing particles were extremely evenly distributed across the peripheral surface of the charge roller while removing the contamination an the charge roller. This embodiment was effective to prevent the charge roller from being contaminated by the toner which slipped by the cleaner when the printing test was continued. It was also effective to prevent charging performance enhancing particles from being unstably held on the charge roller, and to prevent charging performance enhancing granules with an abnormally small dieter from adhering to the charge roller.

Even in the case of Embodiment 4 in which the image forming apparatus was not equipped with a drum cleaner, and toner was recycled, a proper amount of charging performance enhancing particles was supplied to the charge roller evenly across its peripheral surface, by delivering the granulated charging performance enhancing agent to the charging roller through the mash, and the charging performance enhancing agent stored in the shell was not contaminated by the entering of the residual toner into the shell.

(Miscellaneous)

Figure 9:
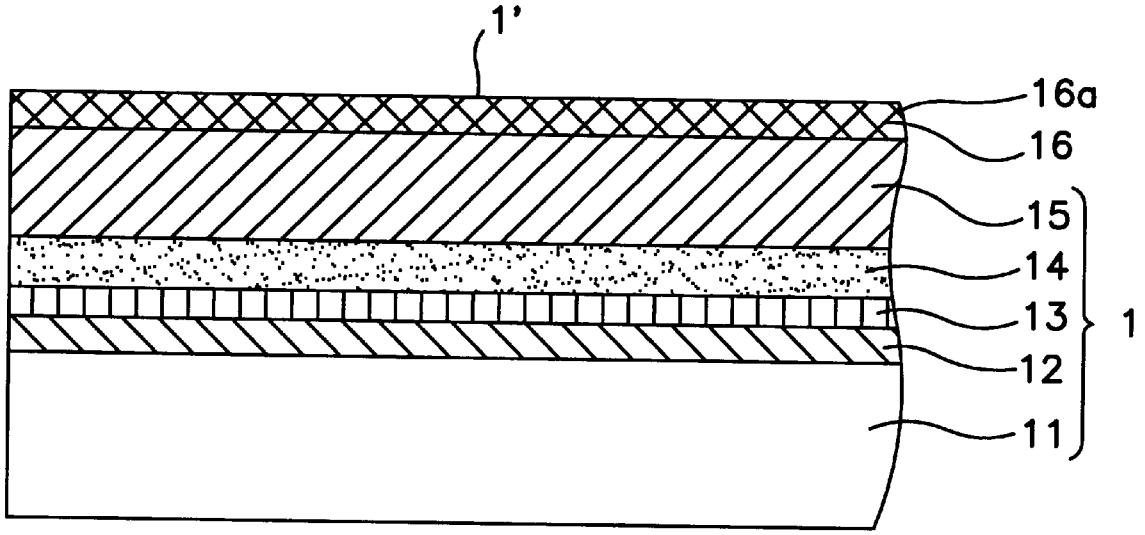
FIG. 9 is a schematic sectional view of the laminar structure of a photosensitive member with a charge injection layer.

It is desired that the surface resistance of the photosensitive drum 1 is adjusted by providing the photosensitive drum 1 with a charge injection layer as the outermost layer. FIG. 9 is a schematic sectional view of the peripheral portion of a photosensitive member 1', the surface layer of which is a charge injection layer. It shows the peripheral structure of the photosensitive member 1'. The photosensitive drum 1' is a photosensitive drum created by coating a charge injection layer 16 on the peripheral surface of an ordinary organic photosensitive drum which comprises a base member 11 (aluminum drum) and four functional layers; an undercoat layer 12, a positive charge injection prevention layer 13, a charge generation layer 14, and a charge transfer layer 15, which are coated in layers in this order on the base member 11. The charge injection layer 16 is coated to improve the performance of an ordinary organic photosensitive member. The material for the charge injection layer 16 is composed by dispersing microscopic particles 16*a* (approximately 0.03 $\mu$m in diameter) of $SnO^2$, that is, electrically conductive particles (electrically conductive filler), polymerization initiating agent, and the like, into optically curable acrylic resin, that is, binder. This material is coated and optically cured into thin film. Lubricant such as tetrafluoroethylene (Commercial name: Teflon) may be added as an ingredient for the charge injection layer to reduce the surface energy of the drawn so that the adhesion of charging performance enhancing particles to the drum can be controlled. The most important aspect of the charge injection layer 16 is its electrical surface resistance. In a charging system based on a direct charge injection principle, reducing the electrical resistance on the side of an object to be charged enhances the efficiency with which electrical charge is exchanged. On the other hand, it is not desired that the electrical resistance on the side of the object to be charged is extremely low. For example, a photosensitive member, that is, an object to be charged, is required to sustain an electrostatic latent image for a certain length of time. Thus, the proper range for the volumetric resistivity of the charge injection layer 16 is $1\times10^{9}$–$\times10^{14}$ (Ω.cm). The volumetric resistivity of the charge injection layer 16 was determined by measuring a sample sheet of the film form of the aforementioned material for the layer 16 with the use of Resistivity Cell 16008A (Yokagawa-Hewlette-Packard) connected to High Resistance Meter 4329A (Yokogawa-Hewlette-Packard). The voltage applied for the measurement was 100 V. However, even in the case of a photosensitive member which is not provided with the charge injection layer (16) unlike the above described photosensitive drum 1, as long as the electrical resistance of the charge transfer layer 15 of a photosensitive member is within the aforementioned range, the same effects as those described above can be obtained. Further, the same effects can be obtained also by a photosensitive member based on amorphous silicon or the like, which is approximately $10^{13}$ Ω.cm in surface electrical resistance.

As is evident from the description given above, according to the present invention, electrically conductive agent is stored in the form of a granule which disintegrates into individual electrically conductive microscopic particles. Therefore, as the electrically conductive agent is coated on a charge roller, it is likely to become uniform in the longitudinal direction, as the carrier and toner in the developing agent become as they are coated on a development roller. Further, the amount by which the electrically conductive agent is coated is proper, preventing the electrically conductive particles from stacking in layers. Therefore, it does not occur that the electrically conductive particles which were coated on the charging member transfer from the charging member onto an image bearing member. Lastly, the electrically conductive agent is not stored in the primary form, that is, in the form of a microscopic particle. Therefore, the amount by which the agent is scattered is very small.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus for charging a member to be charged, said charging apparatus comprising:

a charging member for electrically charging the member to be charged; and electroconductive particle applying means for loosening electroconductive particles stored in the form of a large number of granules each comprising aggregated electroconductive particles and supplying the loosened electroconductive particles to said charging member, wherein the granules have a size of 0.1–10 mm.

2. A charging apparatus for charging a member to be charged, said charging apparatus comprising:

a charging member for electrically charging the member to be charged; and electroconductive particle applying means for loosening electroconductive particles stored in the form of a large number of granules each comprising aggregated electroconductive particles and supplying the loosened electroconductive particles to said charging member, wherein an abrasion ratio of the granule is not less than 20% and not more than 80%.

3. A charging apparatus for charging a member to be charged, said charging apparatus comprising:

a charging member for electrically charging the member to be charged; and electroconductive particle applying means for loosening electroconductive particles stored in the form of a large number of granules each comprising aggregated electroconductive particles and supplying the loosened electroconductive particles to said charging member, wherein said charging member has a surface foam layer.

4. A charging apparatus for charging a member to be charged, said charging member apparatus comprising:

a charging member for electrically charging the member to be charged, said charging member has a surface rubber layer; and electroconductive particle supplying means for loosening electroconductive particles stored in the form of granules each comprising aggregated electroconductive particles and supplying the loosened electroconductive particles to said charging member;

wherein said electroconductive particle supplying means includes a regulating member for regulating an amount of supply of the electroconductive particles, and wherein the regulating member is pressed against the rubber layer.

5. A charging apparatus for charging a member to be charged, said charging apparatus comprising:

a charging member for electrically charging the member to be charged; and electroconductive particle applying means for loosening electroconductive particles stored in the form of a large number of granules each comprising aggregated electroconductive particles and supplying the loosened electroconductive particles to said charging member, wherein the electroconductive particles have an average particles size of 50 nm–5 μm.

6. A charging apparatus for charging a member to be charged, said charging apparatus comprising:

a charging member for electrically charging the member to be charged; and electroconductive particle applying means for loosening electroconductive particles stored in the form of a large number of granules each comprising aggregated electroconductive particles and supplying the loosened electroconductive particles to said charging member, wherein the loosened electroconductive particles are rubbed with said charging member, by which the electroconductive particles are further loosened.

* * * * *

UNITED STATES PATENT AND TRADEMARK OFFICE

CERTIFICATE OF CORRECTION

PATENT NO. : 6,298,205 B1
DATED : October 2, 2001
INVENTOR(S) : Yasunori Chigono et al.

It is certified that error appears in the above-identified patent and that said Letters Patent is hereby corrected as shown below:

Column 3,
Line 39, "Is" should read -- is --.

Column 5,
Line 50, "tog" should read -- fog --.

Column 8,
Line 40, "is." should read -- is --.

Column 11,
Line 15, "drive" should read -- driven --;
Line 51, "diameter" should read -- diameter of --; and "mm, it" should read -- mm. It --.

Column 12,
Line 8, "$10^2$ Ω.cm," should read -- $10^{12}$ Ω.cm, --.

Column 14,
Line 18, "5x10/mm$^2$," should read -- 5x$10^5$/mm$^2$, --.

Column 16,
Line 60, "are" should read -- is --; and
Line 66, "form" should read -- form of --.

Column 17,
Line 24, "objects," should read -- object, -- and
Line 42, "Simple" should read -- simple --.

Column 19,
Line 22, "shall" should read -- shell --.

Column 20,
Table, "structures" should read -- structure --; "furbrush" should read -- fur brush --; and "witout" should read -- without --.

Column 22,
Line 24, "an" should read -- on --;
Line 31, "dieter" should read -- diameter --; and
Line 67, "drawn" should read -- drum --.

UNITED STATES PATENT AND TRADEMARK OFFICE

CERTIFICATE OF CORRECTION

PATENT NO. : 6,298,205 B1
DATED : October 2, 2001
INVENTOR(S) : Yasunori Chigono et al.

It is certified that error appears in the above-identified patent and that said Letters Patent is hereby corrected as shown below:

Column 23,
Line 13, "$1x10^9$-$x10^{14}$" should read -- $1x10^9$-$1x10^{14}$ --;
Line 17, "(Yokagawa-Hewlette-Packard)" should read -- (Yokagawa-Hewlett Packard) --; and
Line 18, "(Yokagawa-Hewlette-Packard)" should read -- (Yokagawa-Hewlett Packard) --.

Column 24,
Line 26, "has" should read -- having --;
Line 29, "supplying" should read -- applying --; and
Line 50, "particles" should read -- particle --.

Signed and Sealed this

Twelfth Day of March, 2002

*Attest:*

*Attesting Officer*

JAMES E. ROGAN
*Director of the United States Patent and Trademark Office*